US005414483A

United States Patent [19]

Rökle et al.

[11] Patent Number: 5,414,483

[45] Date of Patent: May 9, 1995

[54] LIQUID WIPER FOR PHOTOGRAPHIC MATERIAL

[75] Inventors: Güter Rökle, Gummersbach; Ubbo Wernicke, Roesrath-Kleineichen; Egon Bachem, Burscheid, all of Germany

[73] Assignee: Agfa Gevaert Aktiengesellschaft, Leverkusen, Germany

[21] Appl. No.: 847,189

[22] Filed: Mar. 6, 1992

[30] Foreign Application Priority Data

Mar. 23, 1991 [DE] Germany ..... 41 09 670.3
May 1, 1991 [DE] Germany ..... 41 14 228.4

[51] Int. Cl.[6] ..... G03D 3/08
[52] U.S. Cl. ..... 354/320; 354/321
[58] Field of Search ..... 354/320, 323, 324, 319, 354/321, 322, 339; 134/648, 64 R, 122 P, 122 R

[56] References Cited

U.S. PATENT DOCUMENTS

| | | | |
|---|---|---|---|
| 3,905,534 | 9/1975 | Lee | 226/184 |
| 4,086,607 | 4/1978 | Müller | 354/322 X |
| 4,650,308 | 3/1987 | Burbury | 354/322 X |
| 4,734,728 | 3/1988 | Muller | 354/324 |
| 4,827,312 | 5/1989 | Ogiwara et al. | 354/304 |
| 4,987,438 | 1/1991 | Goto et al. | 354/319 |
| 5,097,605 | 3/1992 | Kashino et al. | 354/300 |
| 5,168,297 | 12/1992 | Wernicke | 354/324 |
| 5,203,846 | 4/1993 | Kuhns et al. | 271/125 |

FOREIGN PATENT DOCUMENTS

| | | | |
|---|---|---|---|
| 0238924 | 9/1987 | European Pat. Off. . | |
| 3928331 | 2/1991 | Germany . | |
| 62-240970 | 10/1987 | Japan | 354/325 |
| 1530619 | 12/1975 | United Kingdom . | |

*Primary Examiner*—D. Rutledge
*Attorney, Agent, or Firm*—Connolly & Hutz

[57] ABSTRACT

A device for processing photographic materials and comprising at least one tank filled with a liquid, in which a) a number of superposed and successive pairs of rollers are disposed above the level of liquid in the tank,
b) the rollers in each pair are disposed parallel to one another,
c) all the pairs of rollers lie in a vertical plane, and
d) the axes of each pair of rollers are at an angle of 0° to 40° to the horizontal, and in the case of angles deviating from 0° the axes are disposed so that the lowest point of one pair of rollers is below the highest point of the next pair and below the lowest point of the next but one pair and correspondingly the highest point of a pair of rollers is below the lowest point of the next pair and below the highest point of the next pair but one, can efficiently wash the photographic material, using very small amounts of water.

1 Claim, 1 Drawing Sheet

LIQUID WIPER FOR PHOTOGRAPHIC MATERIAL

BACKGROUND OF THE INVENTION

The invention relates to a device for processing photographic materials and comprising at leas% one tank filled with liquid and means for substantially removing the liquid from the photographic material leaving the tank.

During photographic processing, the photographic material (films or paper) undergoes a multi-step process, e.g. developing, washing, bleaching, washing, fixing, washing, stabilising, drying or developing, fixing, washing and drying.

In order substantially to remove adhering water before the photographic material dries, the original method was to use "wipers". This accelerates the drying process and saves the energy which would be needed to evaporate the adhering water.

Occasionally these wipers are also used before and after the individual processing steps, in order to reduce the entrainment of solutions. The aforementioned purposes are served e.g. by rubber lips, which strip the photographic material on one or both sides.

In other known devices, the liquid adhering to the surface is blown away by compressed air. Another method is suction under reduced pressure.

Production of negative pressure is relatively complicated technically, whereas compressed air is simple to use but has the disadvantage that the chemical solutions are finely atomised and penetrate to places where undesirable crystal residues are left after the liquid evaporates.

Another disadvantage of rubber lips is that after prolonged use on material having a given width, they become more extensively worn at the edges than in the middle, and consequently when the format is changed they do not operate uniformly over the entire width of material. They therefore frequently have to be replaced.

Squeeze rollers, through which the photographic material is conveyed under pressure, are also frequently used in photography. Of course, however, they can damage the sensitive gelatine layers, thus impairing the quality of the photograph.

SUMMARY OF THE INVENTION

It has now surprisingly been found that all the listed disadvantages can be avoided by a stripping device constructed as described hereinafter, even though the photographic material is still cleaned extremely efficiently.

The device according to the invention is characterised in that a) a number of superposed and successive pairs of rollers are disposed above the level of liquid in the tank, b) the rollers in each pair are disposed parallel to one another, c) all the pairs of rollers lie in a vertical plane, substantially normal to the plane of the supporting surface and d) the axes of each pair of rollers are at an angle of 0° to 40° to the horizontal, and in the case of angles deviating from 0° the axes are disposed so that the lowest point of one pair of rollers is below the highest point of the next pair and below the lowest point of the next but one pair and correspondingly the highest point of a pair of rollers is below the lowest point of the next pair and below the highest point of the next pair but one.

Accordingly, some or all the pairs of rollers can be disposed parallel to the horizontal (at an angle of 0°).

Preferably however there is a slight inclination to the horizontal, more particularly an angle of 1° to 30° as stated in d).

Preferably alternate pairs of rollers are disposed parallel to one another. Preferably all the pairs of rollers are at the same angle to the horizontal, except that the angle opens towards first one and then the other side.

More particularly, the rollers in each pair are disposed relative to one another so that they always exert approximately the same pressure on the photographic material, irrespective of the thickness thereof. To this end, for example, the rollers can be disposed so as to swing freely eccentrically, or the roller axes can be placed in guides converging in a V shape.

In a preferred embodiment of the device, a supply of liquid is provided at the highest place on the highest pair of rollers. The photographic material, which is conveyed between each pair of rollers after leaving the tank, can thus be treated with a small quantity of a liquid, more particularly water, so that cascade washing is possible with very small quantities in a very narrow space.

There can be a number of superposed pairs of rollers and a number of tanks, the water supply being conveyed in counter-current to the photographic material.

BRIEF DESCRIPTION OF THE DRAWINGS

The device according to the invention is shown in detail in FIGS. 1 and 2, in which.

DETAILED DESCRIPTION OF THE INVENTION

Figures 1, 2:
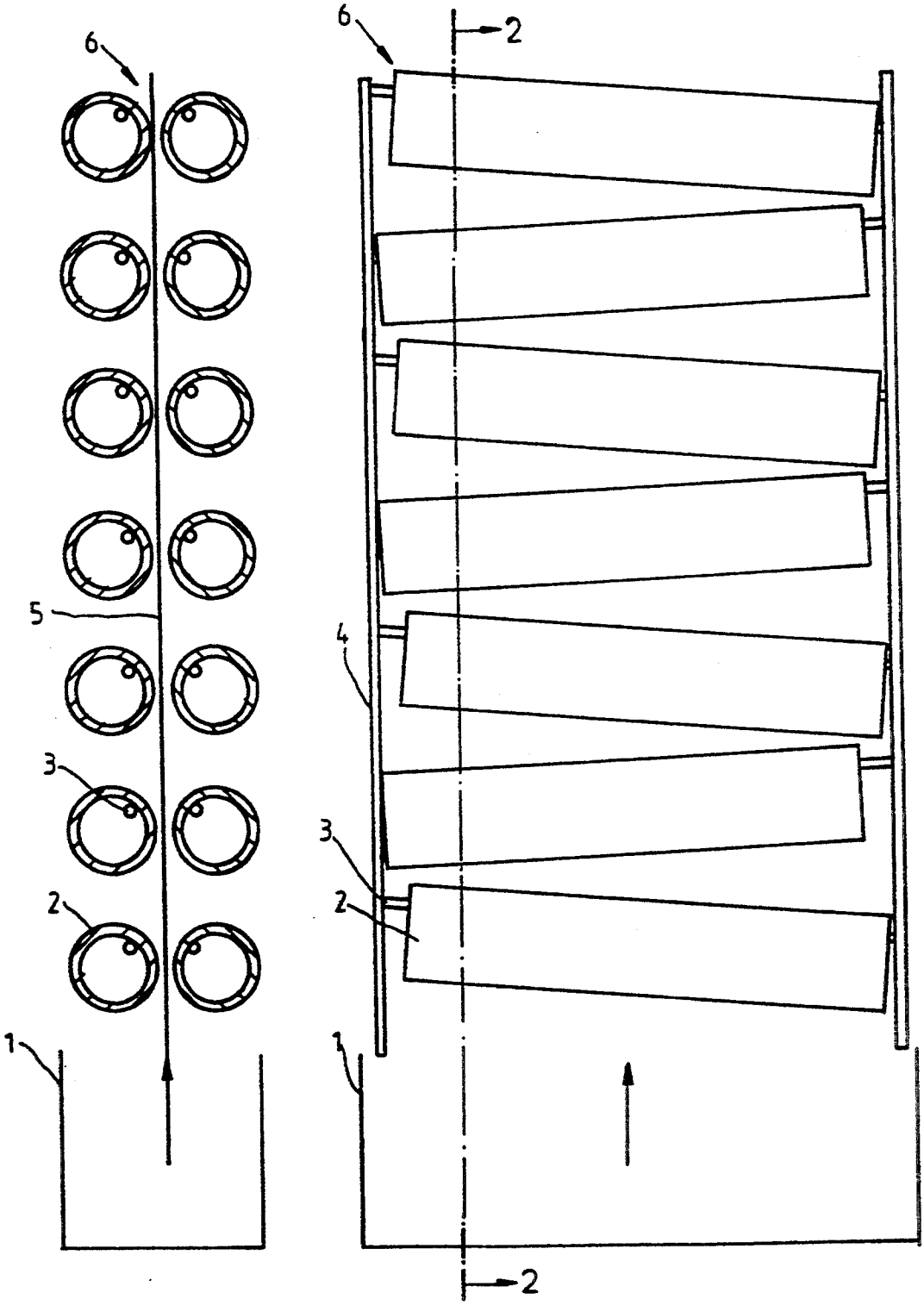
FIG. 1 is a plan view of the device according to the invention.
FIG. 2 is a section through the device along line 2—2 in FIG. 1.

FIG. 1 shows a tank (1) inside a photographic processing device, the tank being e.g. a washing tank, the water level of which is not shown. Pairs of rollers (2) are disposed one above the other on shafts (3) on a frame (4), the front roller of each pair being shown. The rear roller is parallel to the front roller. At point (6) there can be an inlet for washing water, the water being supplied at the highest point on the device to the photographic material (7). Washing water can be supplied at one or both sides of the photographic material. The water runs mostly down the slope before arriving at the next pair of rollers, until it finally drips into the tank (1).

The photographic material is marked (5) in the cross-section in FIG. 2.

Preferably 3 to 100, more particularly 3 to 20 pairs of rollers are provided, and have a width matching the photographic material to be processed. The roller diameter is not critical; for reasons of space, a diameter between 1 and 10 cm is preferred.

EXAMPLES

Example 1 (Comparison)

A photographic film 35 mm wide ran through a developer, a washing unit, a bleaching bath, a washing unit, a fixing bath, a washing unit and was finally dried.

The composition of the bleaching bath was as follows:

| | |
|---|---|
| NH4Br | 140 g/l |
| (NH4) FeEDTA | 70 g/l |
| EDTA acid | 10 g/l |
| pH | 6.0 |

The film remained in the bleaching bath for 4 minutes 20 seconds, at a temperature of 37.8°. After the bleaching bath, the film entered a small washing tank holding 0.5 l.

The material then ran through a second washing tank, capacity 5.0 l.

Rate of advance: 5 m/min.

Washing rate: 200 ml/m$^2$ in washing tank 1. The washing tank 2 was not supplied with fresh water.

After 30 minutes 5 m$^2$ of film had run through the apparatus. The content of NH4Br in tank 2 was determined by analysis, as a measure of the entrainment of bleaching bath into the washing water.

| | |
|---|---|
| Tank 2: NH4Br | 9.5 g/l |

Example 2 (according to the invention)

The procedure was as in Example 1, except that the device according to the invention was mounted on the outlet side of the material above tank 1. Total: six pairs of rollers, roller diameter 2 cm. The angle of the pairs of rollers to the horizontal was 2°, the pairs of rollers being disposed relative to one another so that adjacent pairs included an angle of 4° (see FIG. 1). Length of each roller: 5 cm. The water supply to tank 1 was then shut off, and replaced by 200 ml/m$^2$ in drops on to the top pair of rollers. The water reached the last pair of rollers before entering the tank 1.

In order to demonstrate the effectiveness of the apparatus according to the invention, the concentration of NH4Br in tank 2 was again determined,

| | |
|---|---|
| Tank 2: NH4Br | 1.7 g/l |

Result: Using the same amount of water, the photographic material was cleaned more than five times better with the stripper according to the invention than without it.

We claim:

1. A device for processing photographic materials comprising at least one tank filled with liquid and a means for substantially removing the liquid from the photographic material leaving the tank, wherein a) a number of superposed and successive pairs of rollers are disposed above the level of liquid in the tank, b) the rollers in each pair are disposed parallel to one another in a plane, c) all the pairs of rollers are arranged along and in a vertical plane above said tank, and the axes of each pair of rollers are at an angle of 0° to 40° to the horizontal, and in the case of angles deviating from 0° the axes are disposed so that the lowermost point of one pair of rollers is underneath the uppermost point of the next higher pair and underneath the lowermost point of the next but one higher pair and correspondingly the uppermost point of a pair of rollers is underneath the lowermost point of the next higher pair and underneath the uppermost point of the next pair but one higher d) alternate pairs of rollers are disposed parallel to one another, e) the rollers in each pair are disposed relative to one another so that they always exert approximately the same pressure on the photographic material, irrespective of the thickness thereof and f) a supply of liquid is provided at the highest place on the highest pair of rollers, whereby water may run down the material and rollers to drip into the tank.

* * * * *